US006421449B1

(12) United States Patent
Hasegawa et al.

(10) Patent No.: US 6,421,449 B1
(45) Date of Patent: Jul. 16, 2002

(54) SPEAKER

(75) Inventors: Akinori Hasegawa, Hyogo; Fumiyasu Konno; Masahide Onishi, both of Osaka, all of (JP)

(73) Assignee: Matsushita Electric Industrial Co, Ltd., Osaka (JP)

( * ) Notice: Subject to any disclaimer, the term of this patent is extended or adjusted under 35 U.S.C. 154(b) by 0 days.

(21) Appl. No.: 09/526,726

(22) Filed: Mar. 16, 2000

(30) Foreign Application Priority Data

Mar. 16, 1999 (JP) ..... 11-69754

(51) Int. Cl.[7] ..... H04R 1/00
(52) U.S. Cl. ..... 381/401; 381/407; 381/410
(58) Field of Search ..... 381/400–401, 381/406, 407, 408, 409, 410, 412, 415, FOR 154, FOR 155, FOR 156

(56) References Cited

U.S. PATENT DOCUMENTS 4,295,006 A * 10/1981 Tanaka et al.
5,446,797 A * 8/1995 Paddock
5,594,805 A * 1/1997 Sakamoto et al.
5,832,096 A * 11/1998 Hall

FOREIGN PATENT DOCUMENTS

| | | | |
|---|---|---|---|
| JP | 55-37070 | * | 3/1980 |
| JP | 58-106997 | * | 6/1983 |
| JP | 60-212100 | * | 10/1985 |
| JP | 4-1000 | * | 1/1992 |

* cited by examiner

*Primary Examiner*—Sinh Tran
(74) *Attorney, Agent, or Firm*—Wenderoth, Lind & Ponack, L.L.P.

(57) ABSTRACT

A speaker having a voice coil bobbin wound around with the voice coil and a detection coil together. The detection coil is formed by a wire whose diameter is smaller than one fourth of that of the wire used for the voice coil, and wound in a space among the voice coil wires. In another example, the voice coil and the detection coil are formed using a flat type wire. In a speaker made in accordance with the present invention, the outer diameter of the whole coil structure containing a voice coil and a detection coil does not increase; as a result, decrement of the magnetic flux density in magnetic gap does not occur. Thus, the signals that proportionately represent the speaker vibration are made available without inviting deterioration in the efficiency of a speaker, nor an increased $Q_0$.

5 Claims, 7 Drawing Sheets

SPEAKER

BACKGROUND OF THE INVENTION

1. Field of the Invention

The present invention relates to a speaker having a function for delivering a signal that is proportionate to vibration of the diaphragm.

2. Description of the Prior Art

In order to see the state of a vibrating speaker diaphragm, it is sometimes necessary to pick up a signal that is proportionate to vibration of the diaphragm. A conventional speaker provided with a detection coil wound around the voice coil bobbin for obtaining such proportionate signal is illustrated in FIG. 8.

The magnetic circuit 5 of the speaker is formed of a ring-shaped magnet 3 disposed on a plate 2 having a center pole 1, and an upper plate 4. A frame 11 is connected on the magnetic circuit 5, and a cone-shape diaphragm 13 is adhered to the peripheral part of the frame 11 via an edge 12. A voice coil bobbin 9 wound around with a voice coil 7 and a detection coil 8 is connected to the diaphragm 13 at the center the bobbin, at its middle part, is also connected to the frame 11 via a damper 10. The diaphragm 13 is attached in the center with a dust cap 14. Terminals 16, 18 provided on the frame 11 are attached respectively with flexible wires 15, 17; the respective other ends of the flexible wires 15, 17 are connected to the voice coil 7 and the detection coil 8 at a place in the middle of the voice coil bobbin 9.

When an electric signal is applied to the terminal 16, the voice coil 7 disposed in a gap 6 of the magnetic circuit 5 moves in accordance with Fleming's left-hand rule to vibrate the diaphragm 13, which is connected with the voice coil bobbin 9. As a result, the diaphragm 13 generates a sound. As a result, in accordance with Fleming's right-hand rule, an electric signal is induced in the detection coil 8 in proportion to the motion of voice coil 7. The electric signal is delivered outside through the terminal 18.

In the conventional speaker of the above configuration, which has a detection coil 8 wound around voice coil bobbin 9 for delivering the proportionate signals out, both the detection coil 8 and the voice coil 7 are formed with a same diameter wire having round cross section in two winding layers respectively, as illustrated in FIG. 9. This structure makes the outer diameter of the whole coil structure larger which eventually requires making the gap 6 proportionately wider. This causes problems; namely, the magnetic flux density in the magnetic gap 6 decreases, efficiency of the speaker deteriorates, furthermore, the $Q_0$ (sharpness of resonance) increases.

SUMMARY OF THE INVENTION

The present invention addresses the above problems. A speaker of the present invention forms a detection coil with a wire thinner than one fourth the diameter of that of the voice coil wound around the bobbin by making use of a space existing among the coiled wire of the voice coil. Another speaker of the present invention forms both the voice coil and the detection coil with a flat type wire, for obtaining the same sound output and the same detection capability as the conventional speaker without inviting increased overall dimensions of the whole coil structure.

In accordance with the structure of the present invention, the outer diameter of a coil containing a voice coil and a detection coil does not increase, the density of magnetic flux in the magnetic gap does not decrease. Thus a signal that proportionately represents the vibration of diaphragm is made available without inviting deteriorated speaker efficiency and an increased $Q_0$.

DETAILED DESCRIPTION OF THE INVENTION

Speakers in accordance with exemplary embodiments of the present invention are described in the following with reference to the drawings.

First Embodiment

Figure 1:
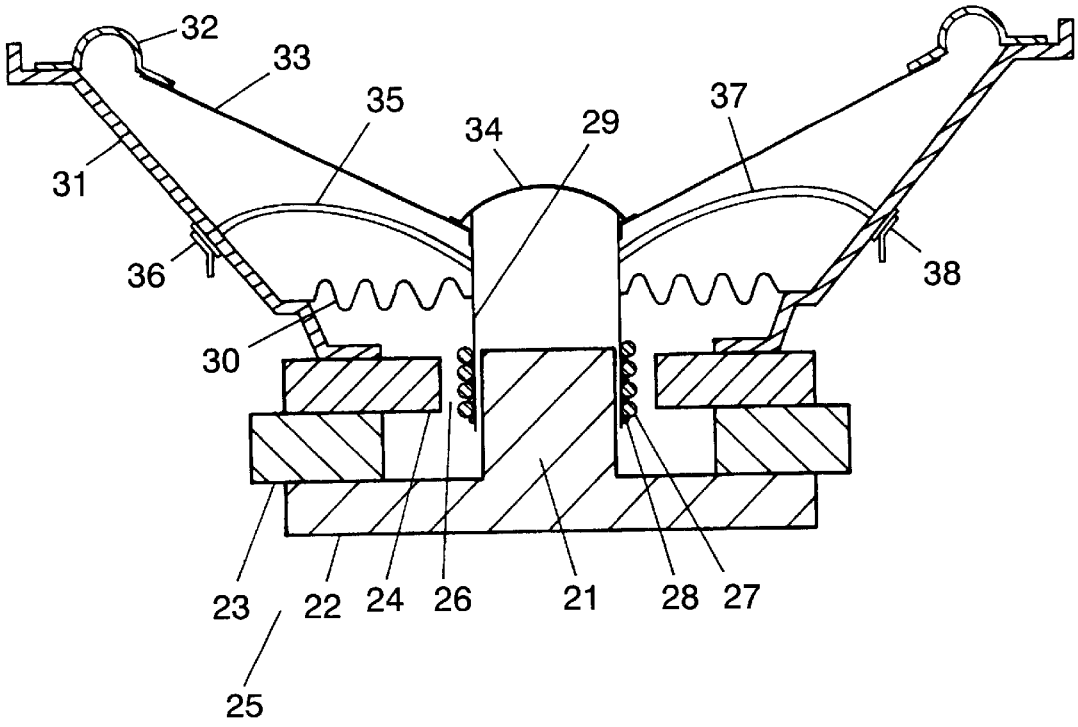
FIG. 1 is a cross sectional view of a speaker in accordance with a first embodiment of the present invention.
Figure 2:
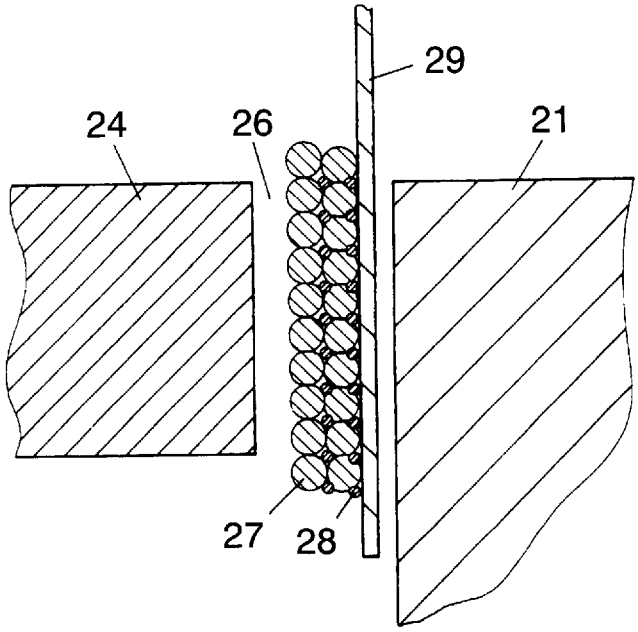
FIG. 2 is a magnified cross sectional view of the voice coil portion in the first embodiment.

FIG. 1 shows a cross sectional view of a speaker in a first exemplary embodiment of the present invention.

Magnetic circuit 25 in the present embodiment is formed of a plate 22 having a center pole 21, a ring-shape magnet 23, and a ring-shape upper plate 24 disposed on the magnet 23. These are connected together with an adhesive. On the top of the upper plate 24, a frame 31 is connected by welding or by adhering, and the frame 31 is connected at the circumference to an edge 32. The edge 32 is made of a flexible and elastic material, and is connected with the peripheral part of a diaphragm 33.

A voice coil bobbin 29 is connected with the diaphragm 33 at the center, which voice coil bobbin 29 is wound around at the lower part with a voice coil 27 and a detection coil 28. The voice coil bobbin 29 is held in a magnetic gap 26 of the magnetic circuit 25 without an eccentricity, and supported at the middle part by a damper 30. The damper 30 is connected at the circumference to the frame 31. The voice coil bobbin 29 disposed at the center of the diaphragm 33 is capped at the top with a dust cap 34. The voice coil 27 is connected to a terminal 36 with flexible wires 35, while the detection coil 28 is connected to a terminal 38 with flexible wires 37.

Operation of the speaker is described next. Electric signals applied to the terminal 36 are delivered to the voice coil 27 via the flexible wires 35. The voice coil bobbin 29 makes a piston motion driven in accordance with Fleming's left-hand rule by the magnetic flux in the magnetic gap 26 and the electric current flowing in the voice coil 27. The piston motion moves the diaphragm 33, and the diaphragm outputs sound in accordance with the electric signal. Now, in accordance with Fleming's right-hand rule, an electromotive force is induced in the detection coil 28. The electromotive force flows through the flexible wire 37 to be picked up from the terminal 38.

The driving force F (unit: N) generated in voice coil 27 by the electric signal delivered to the voice coil 27 is represented by equation 1 below. Where; "I" is electric current in the voice coil 27 (unit: A), "l" is length of the voice coil 27 disposed in the magnetic gap 26, "B" is density of magnetic flux in the magnetic gap 26 (unit: Web/$m^2$). The electromotive force E (unit: V) induced in the detection coil 28 by the motion of the voice coil bobbin 29 is represented by equation 2 below. Where; "V" is velocity of the motion of voice coil bobbin 29 (unit: m/s). Either of the driving force F and the electromotive force E are in proportion to the magnetic flux density in the magnetic gap 26. The $Q_0$ of a speaker is inversely proportionate to the square of the magnetic flux density in the magnetic gap 26.

$$F=BlI \quad \text{(equation 1)}$$

$$E=BlV \quad \text{(equation 2)}$$

The detection coil 28 in a speaker of the present embodiment is formed by a wire whose diameter is less than one fourth of that of the wire of voice coil 27, and is wound by making use of a space existing among the coiled wire of the voice coil 27. With the above structure, the outer diameter of the whole coil structure formed of the voice coil 27 and the detection coil 28 remains the same as that without having the detection coil 28. Therefore, in designing a speaker, there is no need to expanding the magnetic gap 26; hence, there is no decrease in the density of magnetic flux in the magnetic gap 26.

As described in the above, a speaker in the present embodiment enables electric signals that are in proportion to the vibration of diaphragm to be picked up, without inviting deteriorated speaker efficiency, nor an increased $Q_0$. Thus the state of diaphragm vibration can be precisely detected without causing deterioration in the speaker efficiency.

Second Embodiment

A speaker in a second exemplary embodiment is described with reference to FIG. 3 and FIG. 4. A speaker in the present second embodiment differs from that of the first embodiment in the following three points:

(1) A flat type wire is used for the voice coil 27, in place of the round wire used in embodiment 1. The cross sectional shape of the flat type wire is a rectangle having the same area as that of a round wire whose cross sectional area is complying in calculation with the electric current of the speaker, and the width of the flat type wire being the same as diameter of the round wire as shown in FIG. 4.

(2) A detection coil 28 is formed with a flat type wire. The Thickness of the flat type wire is equivalent to a value obtained by subtracting the length of the shorter side of the flat type wire from a diameter of the round wire of the voice coil 27.

(3) First, a detection coil 28 is formed by winding the flat type wire around the voice coil bobbin 29 in a manner that the direction of thickness of the flat type wire (direction of shorter side of the cross sectional rectangle) is perpendicular to the outer surface of voice coil bobbin 29. Next, a voice coil 27 is formed on the outer surface of the detection coil 28 by winding the flat type wire so that the direction of thickness of the flat type wire is perpendicular to the outer surface of the voice coil bobbin 29.

Figure 3:
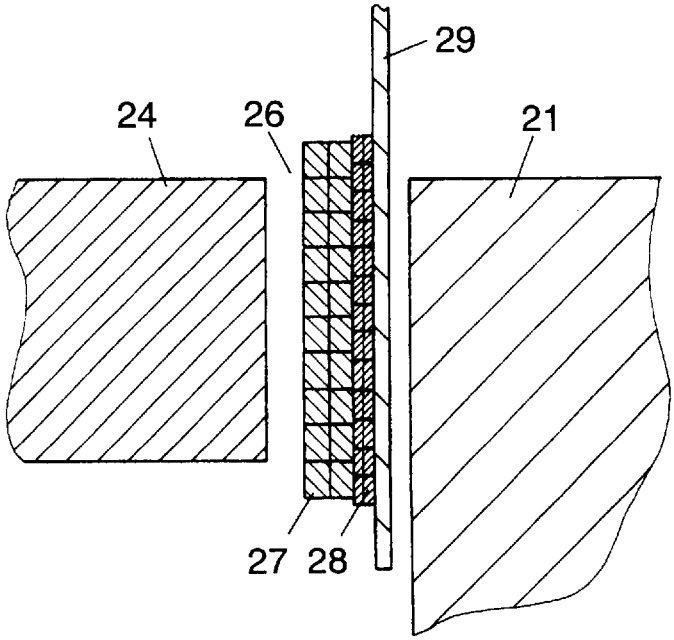
FIG. 3 is a cross sectional view showing details of the voice coil portion in a second embodiment.
Figure 4:
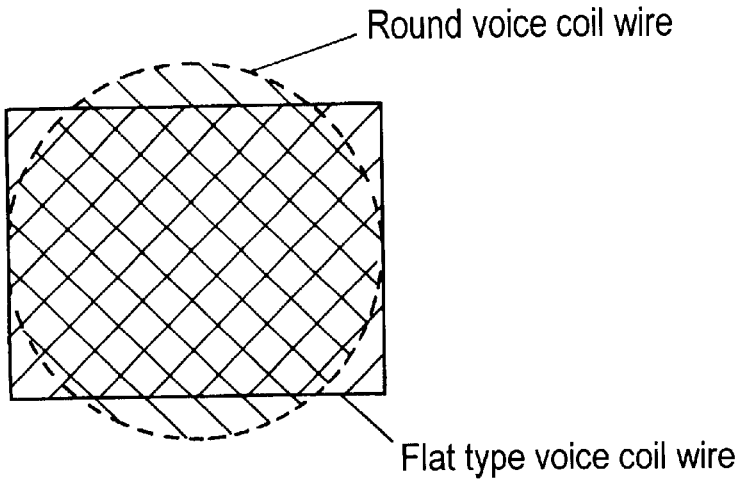
FIG. 4 is a cross sectional view of a voice coil wire in the second embodiment.

The above described structure shown in FIG. 3 provides the same effect as that in the first embodiment. Furthermore, the two coils wound around without any idle space make efficient use of the magnetic flux in the magnetic gap 26, contributing to an increased efficiency of the speaker.

Third Embodiment

Figure 5:
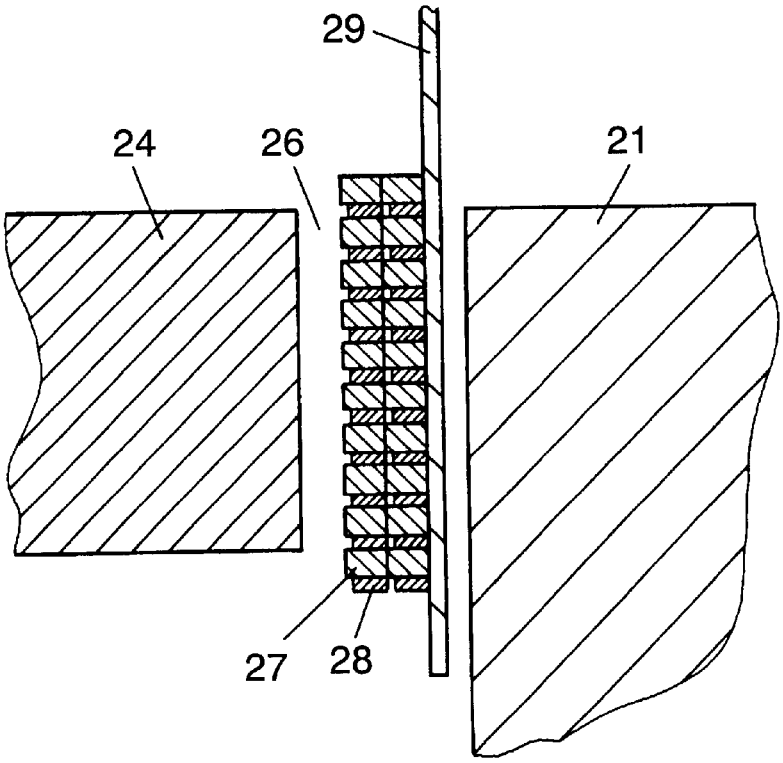
FIG. 5 is a cross sectional view showing details of the voice coil portion in a third embodiment.

A speaker in, a third exemplary embodiment is described with reference to FIG. 5.

A speaker in the third embodiment uses the same flat type wire as that in the second embodiment. The flat type wire is wound around with the thickness direction of wire in parallel with the outer surface of the voice coil bobbin 29 as shown in FIG. 5. Respective wires of voice coil 27 and detection coil 28 are wound stacking one after another in the axial direction of voice coil bobbin 29, i.e., interleaved.

The above described structure provides the same effect as that in the first embodiment. Furthermore, since the flat type wire is wound around in the direction of the wider width, mechanical strength of the voice coil 27 is enhanced to increase a reliability of the voice coil 27.

Fourth Embodiment

Figure 6:
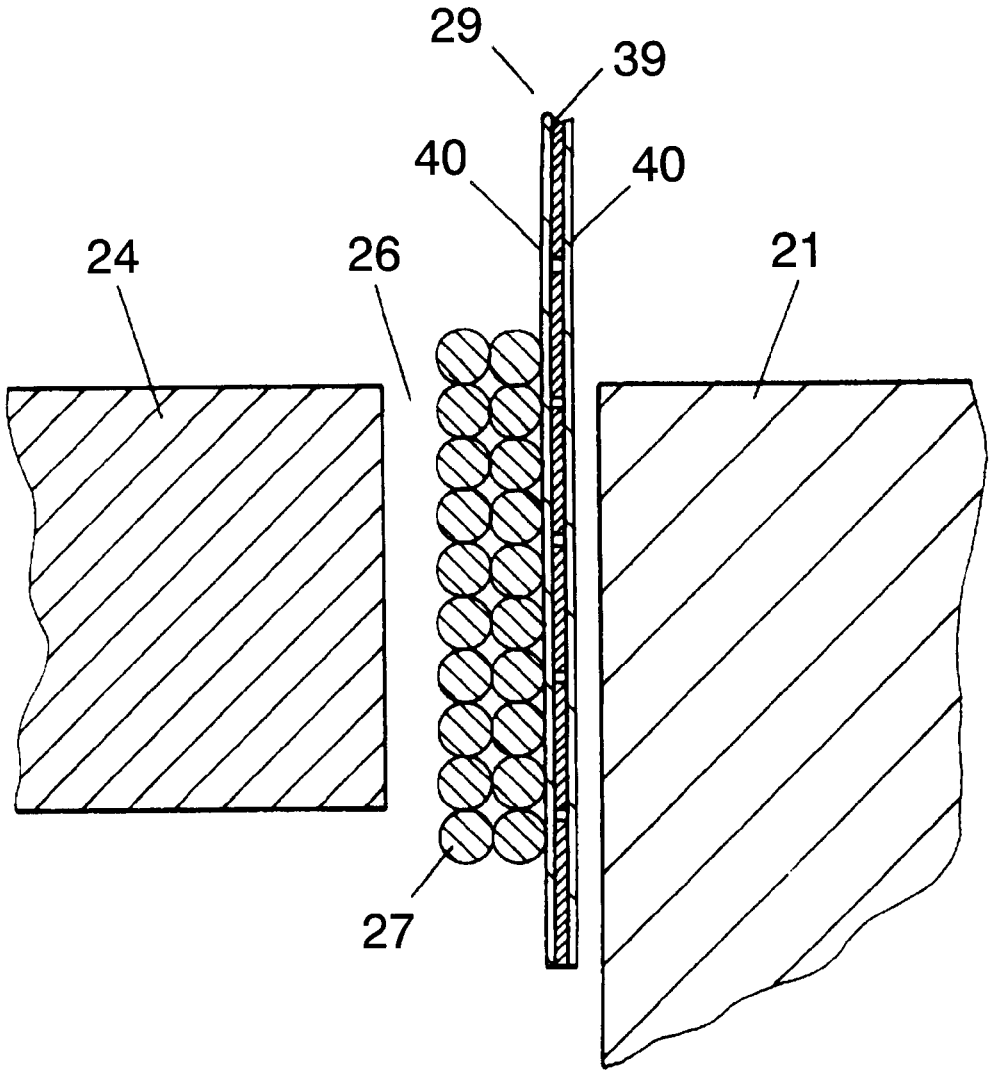
FIG. 6 is a cross sectional view showing details of the voice coil portion in a fourth embodiment.

A speaker in a fourth exemplary embodiment is described with reference to FIG. 6.

A voice coil bobbin 29 of a speaker in the fourth embodiment is formed of a metal foil tape 39 for reinforcement wound spirally with a gap, which metal foil tape 39 is adhered and sandwiched with insulating sheets 40, made of paper or resin, on both surfaces. Signals generated in proportion to the motion of the voice coil bobbin can be taken out from both ends of the metal foil tape 39. Namely, a spirally-wound tape 39 of metal foil is used for the detection coil 28 in the present embodiment.

The above described structure provides the same effect as that in the first embodiment, and the mechanical strength of the voice coil bobbin 29 can be enhanced. Furthermore, since a speaker in the present embodiment does not require any modification in the manufacturing process steps of conventional speakers, a possible increase in the manufacturing cost which could be incurred with the present speaker may be suppressed.

Fifth Embodiment

Figure 7:
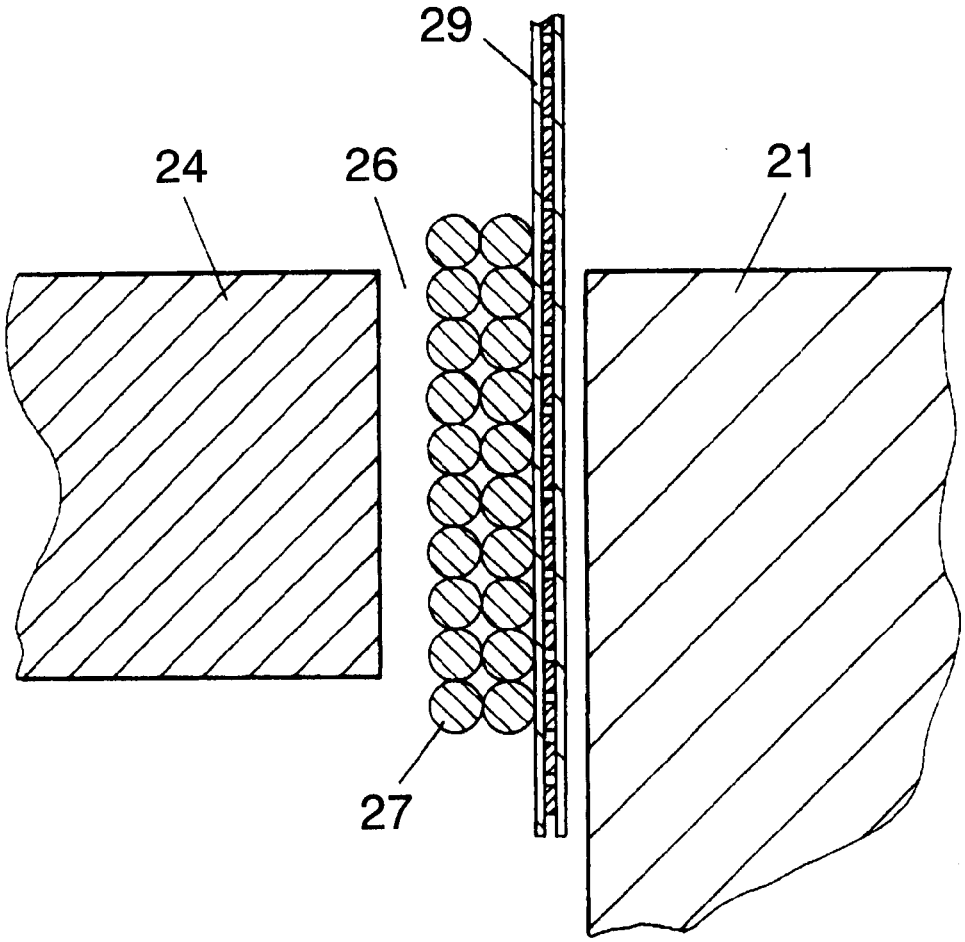
FIG. 7 is a cross sectional view showing details of the voice coil portion in a fifth embodiment.
Figure 8:
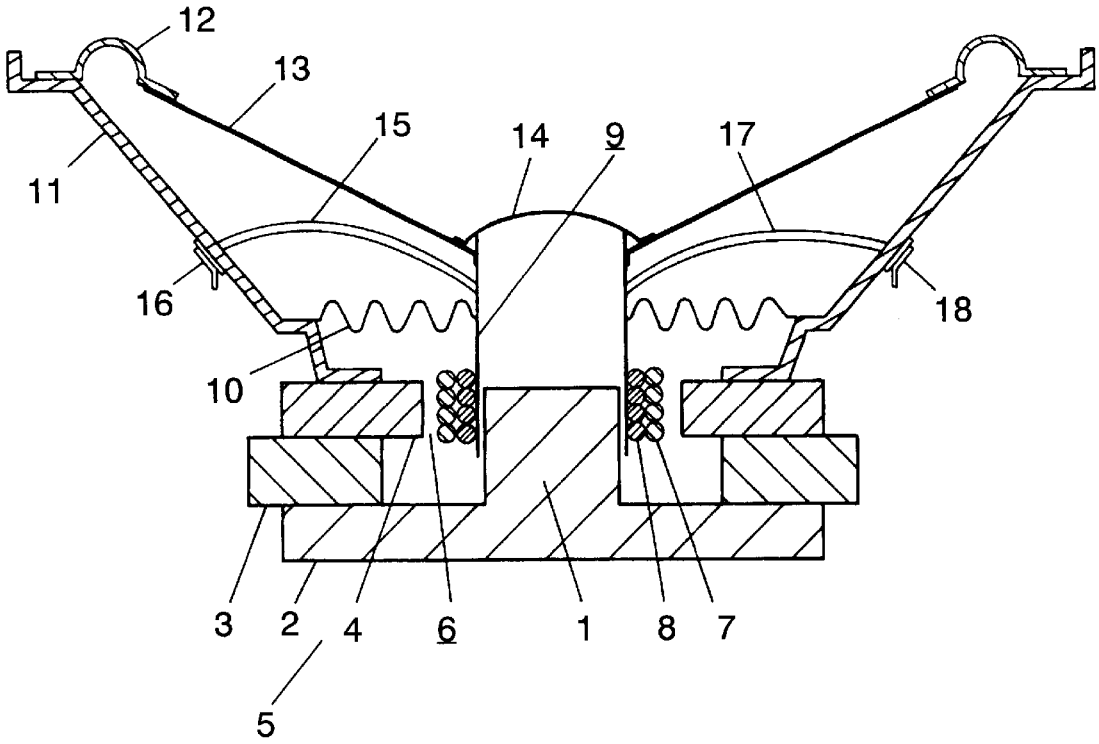
FIG. 8 Prior Art
FIG. 8 is a cross sectional view showing the structure of a conventional speaker.
Figure 9:
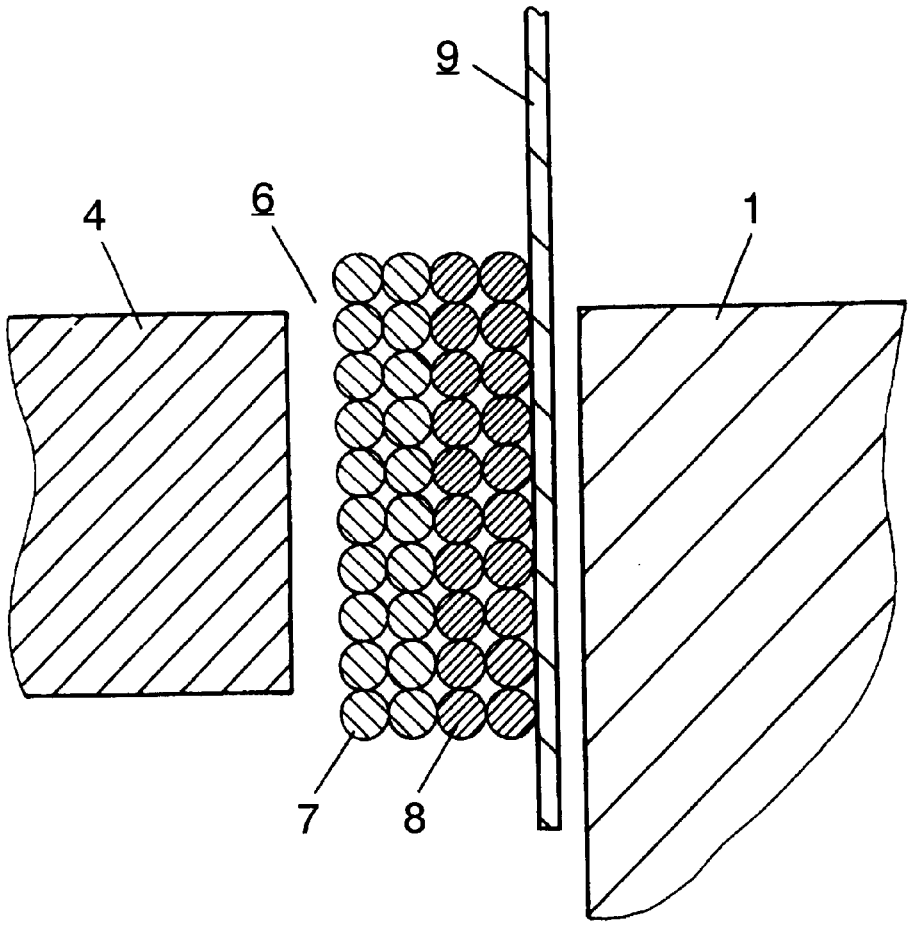
FIG. 9 Prior Art
FIG. 9 is a magnified cross sectional view of the voice coil portion of a conventional speaker.

A speaker in a fifth exemplary embodiment is described with reference to FIG. 7.

A speaker in the fifth embodiment differs from that in the fourth embodiment in that a flexible printed circuit board having an insulating layer on both surfaces rounded into a cylindrical form is used for the voice coil bobbin 29 in the present speaker. The flexible printed circuit board is shaped into a cylindrical form so that a conductive foil contained therein constitute a spiral along the axial direction of the cylinder. Signals generated in proportion to the motion of voice coil bobbin 29 are taken out from both ends of the conductive foil.

The above described structure provides the same effect as that in the fourth embodiment, and the structure keeps a possible increase in the weight of the vibrating parts of a speaker to the minimum.

The detection coil 28 in the above second and third embodiments may be formed instead by using a round wire whose diameter is identical to the thickness of the flat type wire of the detection coil. Furthermore, the sequence of winding the detection coil and the voice coil in the second embodiment may be reversed.

As described in the above, a speaker of the present invention enables electric signals that are in proportion with the vibration of diaphragm to be delivered, without inviting such drawbacks as a deteriorated speaker efficiency or an increased $Q_0$.

What is claimed is:

1. A speaker comprising:

a voice coil bobbin;

a voice coil formed of a wire having a round cross-section with a cross-sectional diameter, said wire of said voice coil being wound around said voice coil bobbin forming voice coil wire windings such that, because of said round cross-section of said wire of said voice coil, space is formed among said voice coil wire windings; and a detection coil formed of wire having a round cross-section with a diameter of less than one fourth said cross-sectional diameter of said wire of said voice coil, said wire of said detection coil being wound around said voice coil bobbin in said space among said voice coil wire windings.

2. A speaker comprising:

a voice coil bobbin formed of a spirally wound metal foil and an insulating sheet of paper or resin on both surfaces of said metal foil, said voice coil bobbin being operable as a detection coil; and a voice coil wound around said voice coil bobbin.

3. A speaker comprising:

a voice coil bobbin formed of a flexible printed circuit board having an insulating layer on both surfaces, said flexible printed circuit board comprising a conductive foil shaped in a spiral operable as a detection coil; and a voice coil wound around said voice coil bobbin.

4. A speaker comprising:

a voice coil bobbin;

a voice coil wound on said voice coil bobbin, said voice coil being formed of a rectangular wire having a cross sectional area, wherein a size of said cross sectional area is determined according to a relationship between an electric current to be used in said speaker and a necessary size and necessary diameter of cross sectional area that would be required for a round wire based on the electric current, said size of said cross sectional area of said rectangular wire being substantially the same as the necessary size, said cross sectional area of said rectangular wire having a length and a width, said length being substantially the same as the necessary diameter, said voice coil being wound with said width of said rectangular wire substantially perpendicular to said outer surface of said voice coil bobbin; and a detection coil wound on said voice coil bobbin, said detection coil being formed of wire having a thickness that is smaller than a value, said value being obtained by subtracting said width of said rectangular wire of said voice coil from the necessary diameter.

5. A speaker comprising:

a voice coil bobbin;

a voice coil wound on said voice coil bobbin, said voice coil being formed of a rectangular wire having a cross sectional area, wherein a size of said cross sectional area is determined according to a relationship between an electric current to be used in said speaker and a necessary size and necessary diameter of cross sectional area that would be required for a round wire based on the electric current, said size of said cross sectional area of said rectangular wire being substantially the same as the necessary size, said cross sectional area of said rectangular wire having a length and a width, said length being substantially the same as the necessary diameter, said voice coil being wound with said length of said rectangular wire substantially perpendicular to said outer surface of said voice coil bobbin; and a detection coil wound on said voice coil bobbin, said detection coil being formed of wire having a thickness that is smaller than a value, said value being obtained by subtracting said width of said rectangular wire of said voice coil from the necessary diameter;

wherein said wires of said voice coil and detection coil are wound interleaved on said voice coil bobbin.

* * * * *